US005317001A

United States Patent [19]

Daly et al.

[11] Patent Number: 5,317,001

[45] Date of Patent: May 31, 1994

[54] THERMAL DYE TRANSFER RECEIVING ELEMENT WITH AQUEOUS DISPERSIBLE POLYESTER DYE IMAGE-RECEIVING LAYER

[75] Inventors: Robert C. Daly; Kristine B. Lawrence, both of Rochester, N.Y.

[73] Assignee: Eastman Kodak Company, Rochester, N.Y.

[21] Appl. No.: 996,345

[22] Filed: Dec. 23, 1992

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS

| | | | |
|---|---|---|---|
| 3,033,822 | 5/1962 | Kibler et al. | 260/47 |
| 3,256,241 | 6/1966 | Watson | 260/47 |
| 3,480,586 | 11/1969 | Forster et al. | 260/47 |
| 3,515,700 | 6/1970 | Yokouchi et al. | 260/75 |
| 3,725,343 | 4/1973 | Schreyer | 260/42 C |
| 3,754,909 | 8/1973 | Feltzin et al. | 96/1.5 |
| 3,767,526 | 1/1974 | Burns et al. | 260/860 |
| 4,612,362 | 9/1986 | Lai et al. | 528/190 |
| 4,695,286 | 9/1987 | Vanier et al. | 8/471 |
| 4,740,497 | 4/1988 | Harrison et al. | 503/227 |
| 4,814,417 | 3/1989 | Sugimori | 528/182 |
| 4,839,337 | 6/1989 | Imai et al. | 503/227 |
| 4,897,377 | 1/1990 | Marbrow | 503/227 |
| 4,912,085 | 3/1990 | Marbrow | 503/227 |
| 4,914,179 | 4/1990 | Morris et al. | 528/272 |
| 4,927,803 | 5/1990 | Bailey et al. | 503/227 |
| 4,950,736 | 8/1990 | Sasaki et al. | 528/370 |
| 4,980,448 | 12/1990 | Tajiri et al. | 528/194 |
| 4,985,536 | 1/1991 | Figuly | 528/272 |
| 5,059,580 | 10/1991 | Shibata et al. | 503/227 |
| 5,071,823 | 12/1991 | Matsushita et al. | 503/227 |
| 5,128,311 | 7/1992 | Egashira et al. | 503/227 |

FOREIGN PATENT DOCUMENTS

| | | | |
|---|---|---|---|
| 0368550 | 5/1990 | European Pat. Off. | 503/227 |
| 0475633 | 3/1992 | European Pat. Off. | 503/227 |
| 62-238790 | 10/1987 | Japan | 503/227 |
| 1-38277 | 2/1989 | Japan | 503/227 |
| 4-133795 | 5/1992 | Japan | 503/227 |

*Primary Examiner*—B. Hamilton Hess
*Attorney, Agent, or Firm*—Harold E. Cole

[57] ABSTRACT

A dye-receiving element for thermal dye transfer includes a support having on one side thereof a dye image-receiving layer. Receiving elements of the invention are characterized in that the dye image-receiving layer comprises a water dispersible polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 2.5 mole % of the dibasic acid derived units and diol derived units combined comprising ionic monomer derived units containing an ionic group.

17 Claims, No Drawings

THERMAL DYE TRANSFER RECEIVING ELEMENT WITH AQUEOUS DISPERSIBLE POLYESTER DYE IMAGE-RECEIVING LAYER

This invention relates to dye-receiving elements used in thermal dye transfer, and more particularly to polymeric dye image-receiving layers for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye receiving elements used in thermal dye transfer generally include a support (transparent or reflective) bearing on one side thereof a dye image-receiving layer, and optionally additional layers. The dye image-receiving layer conventionally comprises a polymeric material chosen from a wide assortment of compositions for its compatibility and receptivity for the dyes to be transferred from the dye donor element. Dye must migrate rapidly in the layer during the dye transfer step and become immobile and stable in the viewing environment. Care must be taken to provide a receiver layer which does not stick to the hot donor and where the dye moves off of the surface and into the bulk of the receiver. An overcoat layer can be used to improve the performance of the receiver by specifically addressing these latter problems. An additional step, referred to as fusing, may be used to drive the dye deeper into the receiver.

Polycarbonates (such as disclosed in U.S. Pat. Nos. 4,695,286 and 4,927,803) and polyesters have been suggested for use in image-receiving layers. While polycarbonates have been found to be desirable image-receiving layer polymers because of their effective dye compatibility and receptivity, they are generally made in solution from hazardous materials (e.g. phosgene and chloroformates) and isolated by precipitation into another solvent.

Polyesters, on the other hand, are advantageous in that they can be readily synthesized and processed by melt condensation using no solvents and relatively innocuous chemical starting materials. Polyesters formed from aromatic diesters (such as disclosed in U.S. Pat. No. 4,897,377) generally have good dye up-take properties when used for thermal dye transfer; however, they exhibit severe fade when the dye images are subjected to high intensity daylight illumination. Polyesters formed from aliphatic diesters generally have relatively low glass transition temperatures (Tg), which frequently results in receiver-to-donor sticking at temperatures commonly used for thermal dye transfer. When the donor and receiver are pulled apart after imaging, one or the other fails and tears and the resulting images are unacceptable.

Polyesters formed from alicyclic diesters are disclosed in copending U.S. Ser. No. 07/801,223 of Daly, the disclosure of which is incorporated by reference. These polyesters generally have good dye up-take and image dye stability properties, but (like the other polycarbonates and polyesters discussed above) they are generally only soluble in organic solvents. The cost of solvent coating such dye-receiving layers is the largest single cost in the manufacture of dye receiver elements. The environmental impact of the coating solvent and the difficulty in complete recovery of low boiling solvent are further disadvantages to continued solvent coating. As such, it would be preferable to coat dye-receiving layers from aqueous systems for cost and environmental purposes.

U.S. Pat. No. 5,071,823 discloses the use of aqueous dispersions of polyester resins, and water soluble polyesters formed from terephthalic acid, sulfonated terephthalic acid and ethylene glycol for thermal dye transfer dye-receiving layers. While such aromatic polyesters may be coatable from water, they exhibit poor image stability.

Accordingly, it would be highly desirable to provide a receiver element for thermal dye transfer processes with a dye image receiving layer having excellent dye uptake and image dye stability, and which was coatable from an aqueous dispersion.

These and other objects are achieved in accordance with this invention which comprises a dye-receiving element for thermal dye transfer comprising a support having on one side thereof a dye image-receiving layer, wherein the dye image-receiving layer comprises a water dispersible polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 2.5 mole % of the dibasic acid derived units and diol derived units combined comprising ionic monomer derived units containing an ionic group.

In a preferred embodiment, at least 20 mole % of the diol derived units of the polyester contain an aromatic ring not immediately adjacent to each hydroxyl group of the corresponding diol or an alicyclic ring.

In a further preferred embodiment, at least 20 mole % of the diol derived units of the polyester contain an alicyclic ring.

In a still further preferred embodiment, at least 5 mole % of the dibasic acid derived units of the polyester comprise dicarboxylic acid derived units containing an ionic group.

The polyester polymers used in the dye-receiving elements of the invention are condensation type polyesters based upon recurring units derived from alicyclic dibasic acids (Q) and diols, wherein (Q) represents one or more alicyclic ring containing dicarboxylic acid units with each carboxyl group within two carbon atoms of (preferably immediately adjacent) the alicyclic ring.

Preferably, at least 30 mole % of the diol derived units are derived from diols of the group (L) comprising diol units containing at least one aromatic ring not immediately adjacent to (preferably from 1 to about 4 carbon atoms away from) each hydroxyl group or an alicyclic ring which may be adjacent to the hydroxyl groups. For the purposes of this invention, the terms "dibasic acid derived units" and "dicarboxylic acid derived units" are intended to define units derived not only from carboxylic acids themselves, but also from equivalents thereof such as acid chlorides, acid anhydrides and esters, as in each case the same recurring units are obtained in the resulting polymer. Each alicyclic ring of the corresponding dibasic acids may also be optionally substituted, e.g. with one or more $C_1$ to $C_4$ alkyl groups. Each of the diols may also optionally be substituted on the aromatic or alicyclic ring, e.g. by $C_1$ to $C_6$ alkyl, alkoxy, or halogen.

In a preferred embodiment of the invention, the alicyclic rings of the dicarboxylic acid derived units and diol derived units contain from 4 to 10 ring carbon atoms. In a particularly preferred embodiment, the alicyclic rings contain 6 ring carbon atoms.

The alicyclic dicarboxylic acid units, (Q), are represented by structures such as:

Q1: 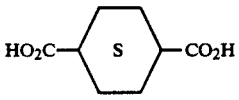

Q2: 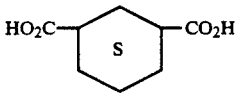

Q3: 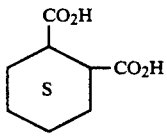

Q4: 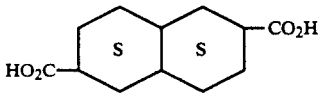

Q5: 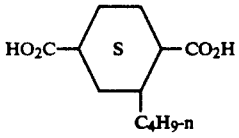

Q6: 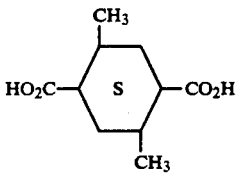

Q7: 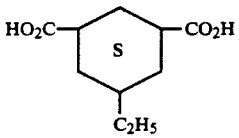

-continued

Q8: 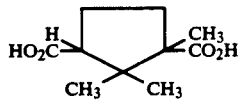

Q9: 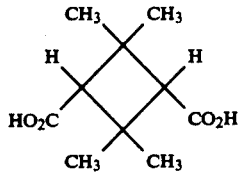

Q10: 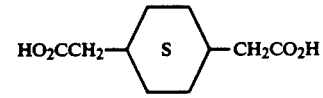

Q11: 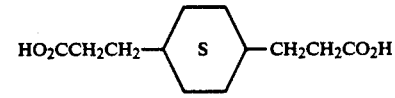

Q12: 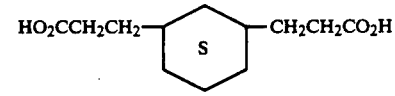

Ionic monomer units are preferably derived from diester monomers (I) which contain metal ion salts of sulfonic acids or iminodisulfonyl groups. Examples of such ionic monomers include those represented by structures such as:

I1: 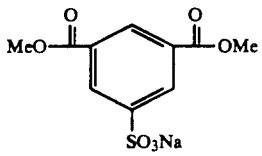

I2: 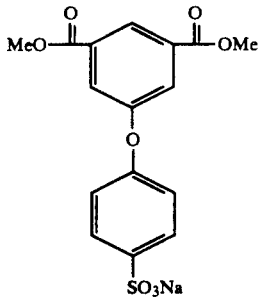

I3: 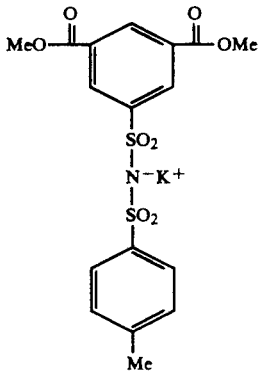

-continued
I4: 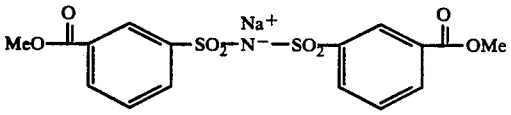
Diester monomer units which contain an iminodisulfonyl group within the atom chain between the two carboxy groups, such as monomer I4 above, are particularly preferred.
L1: 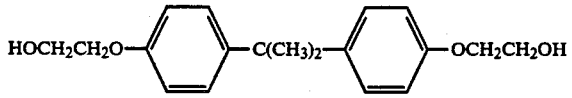
L2: 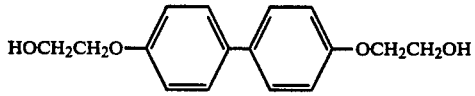
L3: 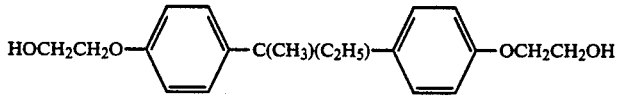
L4: 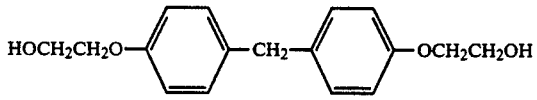
L5: 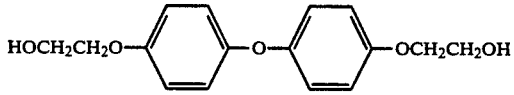
L6: 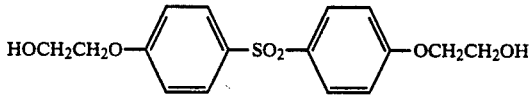
L7: 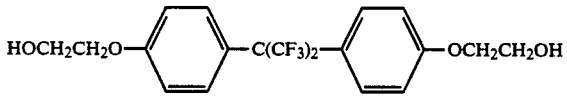
L8: 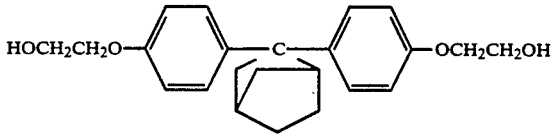
L9: 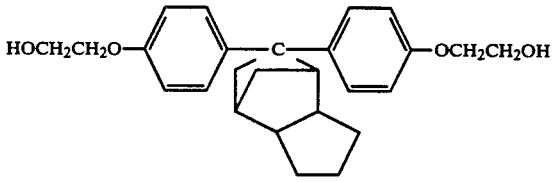
L10: 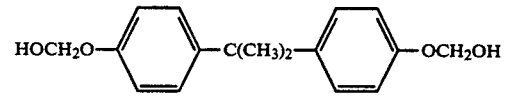
L11: 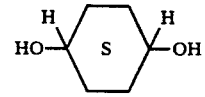

-continued
L12: 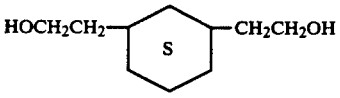
L13: 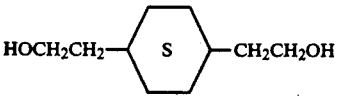
L14: 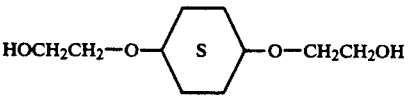
L15: 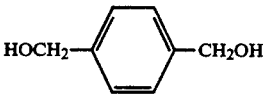
L16: 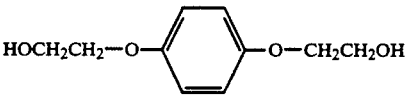
L17: 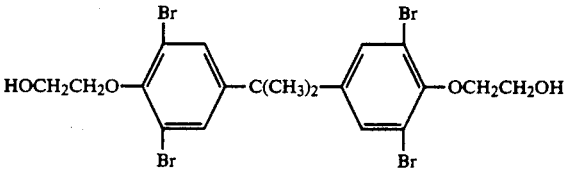
L18: 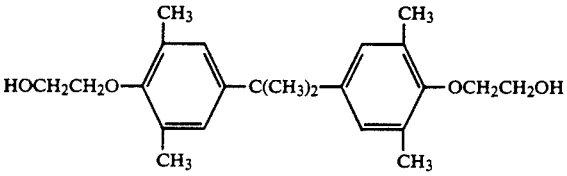
L19: 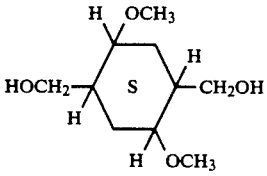
L20: 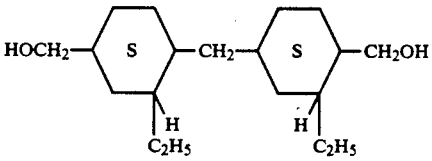
L21: 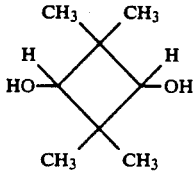
L22: 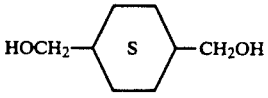

-continued

L23: 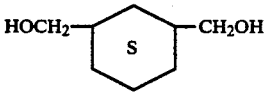

Optionally other groups, R and M, may be copolymerized to produce preferred structures such as:

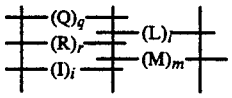

wherein q+r+i=1+m=100 mole %, q is at least 50 mole %, i is preferably from about 5 to about 40 mole % (more preferably from about 8 to 28 mole %), and 1 is preferably at least 20 mole %. At lower levels of ionomer modification (e.g., i less than 5 mole %), the polyesters are difficult to disperse in water. At higher levels of ionomer (e.g., i greater than 40 mole %), the melt viscosity increases to a level such that synthesis becomes difficult.

Diesters R and diols M may be added, e.g., to precisely adjust the polymer's Tg, solubility, adhesion, etc. Additional diester comonomers could have the cyclic structure of Q or be linear aliphatic units. The additional diol monomers may have aliphatic or aromatic structure but are not phenolic.

Suitable groups for R include dibasic aliphatic acids such as:

R1: $HO_2C(CH_2)_2CO_2H$
R2: $HO_2C(CH_2)_4CO_2H$
R3: $HO_2C(CH_2)_7CO_2H$
R4: $HO_2C(CH_2)_{10}CO_2H$

Suitable groups for M include diols such as:

M1: $HOCH_2CH_2OH$
M2: $HO(CH_2)_4OH$
M3: $HO(CH_2)_9OH$
M4: $HOCH_2C(CH_3)_2CH_2OH$
M5: $(HOCH_2CH_2)_2O$
M6: $HO(CH_2CH_2O)_nH$ (where n=2 to 50)

The polyester preferably has a Tg between about 40° C. and 100° C. Higher Tg polyesters may be useful with added plasticizer. In a preferred embodiment of the invention, the polyesters have a number molecular weight of from about 10,000 to about 250,000, more preferably from 20,000 to 100,000.

The following polyester polymers (comprised of recurring units of the illustrated monomers) are examples of polyester polymers usable in the receiving layer of the invention.

P-1: 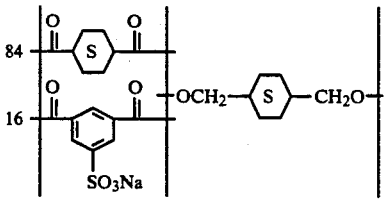

84 mole% dimethyl cis/trans-1,4-cyclohexanedicarboxylate; 16 mole% dimethyl 5-sodiosulfoisophthalate; 100 mole% trans 1,4-cyclohexanedimethanol.

P-2: 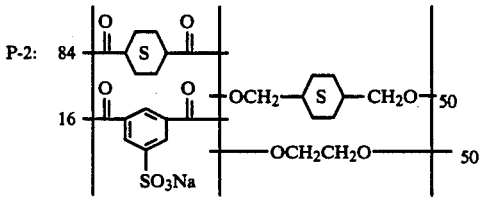

84 mole% dimethyl trans 1,4-cyclohexanedicarboxylate; 16 mole% dimethyl 5-sodiosulfoisophthalate; 50 mole% trans 1,4-cyclohexanedimethanol; 50 mole% ethylene glycol.

P-3: 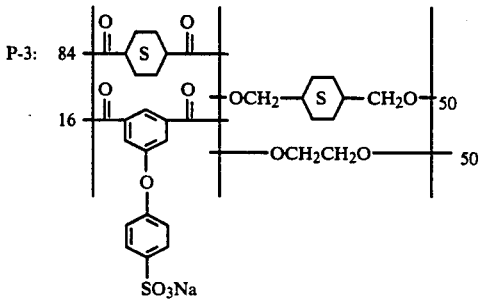

84 mole% dimethyl trans 1,4-cyclohexanedicarboxylate; 16 mole% dimethyl 5-(sodio-4-sulfophenoxy(isophthalate; 50 mole% trans 1,4-cyclohexanedimethanol; 50 mole% ethylene glycol.

P-4: 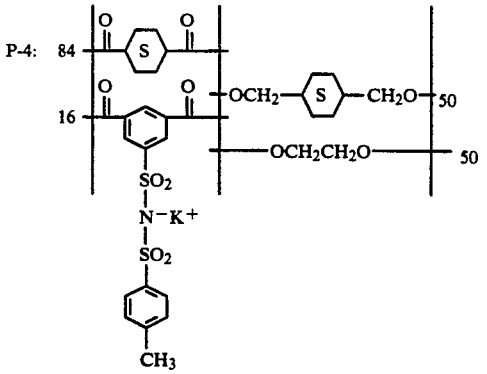

84 mole% dimethyl trans 1,4-cyclohexanedicarboxylate; 16 mole% dimethyl 5-(N-potassio-p-toluenesulfonamido) sulfonyl isophthalate; 50 mole% trans 1,4-cyclohexanedimethanol; 50 mole% ethylene glycol.

P-5:

-continued

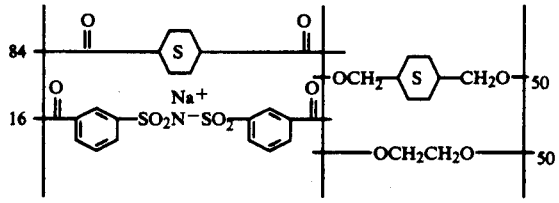

84 mole% dimethyl trans 1,4-cyclohexanedicarboxylate; 16 mole% 3,3'-iminobis(sulfonylbenzoic acid), sodium-nitrogen salt, dimethyl ester; 50 mole% trans 1,4-cyclohexanedimethanol; 50 mole% ethylene glycol.

Other alicyclic polyesters such as those described in copending U.S. Ser. No. 07/801,223 of Daly, the disclosure of which is incorporated by reference above, may be modified by copolymerizing ionic monomer units with the dibasic acid derived units and diol derived units of such polyesters to obtain further examples of polyester ionomers according to the present invention.

The support for the dye-receiving element of the invention may be transparent or reflective, and may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference.

The dye image-receiving layer may be present in any amount which is effective for its intended purpose. In general, good results have been obtained at a receiver layer concentration of from about 0.5 to about 10 g/m$^2$.

Resistance to sticking during thermal printing may be enhanced by the addition of release agents to the dye receiving layer or to an overcoat layer, such as silicone based compounds, as is conventional in the art.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention. The synthesis example is representative, and other polyesters may be prepared analogously or by other methods know in the art.

Preparation of Polyester P-1

The following quantities of reactants were charged to a 250 ml reaction flask equipped with a nitrogen inlet tube and Dean Stark trap: 42 g (0.210 mole) of dimethyl cis/trans 1,4-cyclohexanedicarboxylate, 12 g (0.040 mole) of dimethyl 5-sodiosulfoisophthalate, 36 g (0.250 mole) trans 1,4-cyclohexanedimethanol, 0.3 g (0.004 mole) of sodium acetate, 0.033 g of zinc acetate, 0.033 g of antimony trioxide and 0.05 g of Irganox 1010 (antioxidant from Ciba Geigy). Under a nitrogen purge, the flask was placed in a 210° C. salt bath, was treated with 6–8 drops of tetraisopropyl orthotitanate and left there for 1.5 hours. The temperature was raised to 230° C. over a 1 hour period. 6 drops of trioctylphosphate were added and the distilling head was removed. The reaction flask was attached to a vacuum manifold and fitted with an overhead stirrer set for 200 rpm. When the reaction temperature reached 260° C., the system was placed under house vacuum and held there for 15 minutes. The heating set point temperature was raised to 280° C. and the reaction flask was placed under high vacuum (12 Pa). Over a 1 hour period the melt viscosity built-up gradually. The reaction was terminated at a final torque reading of 180 millivolts at 100 rpm. The flask was removed from the salt bath and upon cooling to room temperature the polymer was removed and ground through a ¼ inch screen yielding 65 g of a grayish-white solid. Tg=58.7° C., IV=0.221.

EXAMPLE 1

Dye-receiving elements were prepared by extrusion laminating a 42 μm thick microvoided composite film (OPPalyte 278 WOS, Mobil Chemical Co., consisting of a microvoided and oriented polypropylene core (approximately 75% of the total film thickness, poly(butylene terephthalate) void initiating material) with a titanium dioxide pigmented non-microvoided orientated polypropylene layer on one side and a non-pigmented, non-microvoided orientated polypropylene layer on the other side) to a 140 μm thick support paper stock (1:1 blend of Pontiac Maple 51 (a bleached maple hardwood kraft of 0.5 mm length weighted average fiber length, Consolidated Pontiac, Inc.) and Alpha Hardwood Sulfite (a bleached red-alder hardwood sulfite of 0.69 mm average fiber length, Weyerhaeuser Paper Co.)) with 12 g/m$^2$ pigmented polyolefin (polyethylene containing anatase titanium dioxide (13% by weight) and a stilbene-benzoxazole optical brightener (0.03% by weight)), the non-pigmented side of the composite film contacting the pigmented olefin. The backside of the stock support was extrusion coated with high density polyethylene (25 g/m$^2$). The composite film side of the resulting laminate was then coated with:

(1) Subbing layer of diafiltered poly(acrylonitrile-co-vinylidene chloride-co-acrylic acid) (15:78:7 wt. ratio)(0.54 g/m2) and Triton TX-100 (an ethoxylated alkyl phenol)(Eastman Kodak Co.) (0.016 g/m$^2$) from distilled water.

(2) Dye-receiving layer composed of a polyester ionomer (P-1 or P-2 described above or comparison polyester C-1, C-2, or C-3 described below) (3.23 g/m$^2$) with Triton TX-100 (Eastman Kodak Co.) (0.016 g/m2) from distilled water.

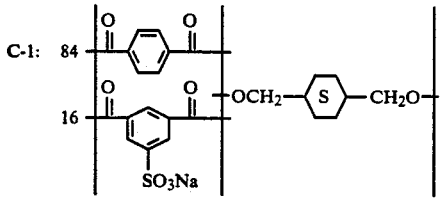

84 mole % dimethyl terephthalate; 16 mole % dimethyl 5-sodiosulfoisophthalate; 100 mole % trans 1,4 cyclohexane dimethanol.

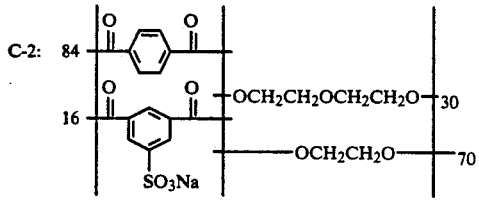

84 mole% dimethyl terephthalate; 16 mole% dimethyl 5-sodiosulfoisophthalate; 30 mole % diethylene glycol; 70 mole% ethylene glycol.

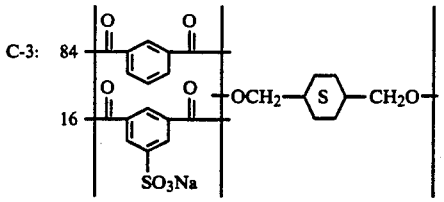

84 mole% dimethyl isophthalate; 16 mole% dimethyl 5-sodiosulfoisophthalate; 100 mole % trans 1,4-cyclohexanedimethanol.

Polymers P-1 and P-2 and comparative polymers C-2 and C-3 were dispersed in water at levels ranging from 10 wt% to 20 wt% prior to coating. Comparative polymer C-1 could not be dispersed in water even at levels as low as 5 wt%. All coatings were dried at ambient room conditions for at least 16 hours prior to evaluation.

A dye donor element of sequential areas of cyan, magenta and yellow dye was prepared by coating the following layers in order on a 6 μm poly(ethylene terephthalate) support:

(1) Subbing layer of Tyzor TBT (titanium tetra-n-butoxide) (duPont Co.) 0.12 g/m$^2$) from a n-propyl acetate and 1-butanol solvent mixture.

(2) Dye-layer containing a mixture of Cyan Dye 1 (0.37 g/m$^2$) and Cyan Dye 2 (0.11 g/m$^2$) illustrated below, a mixture of Magenta Dye 1 (0.14 g/m$^2$) and Magenta Dye 2 (0.15 g/m$^2$) illustrated below. or Yellow Dye 1 illustrated below (0.26 g/m$^2$) and S-363N1 (a micronized blend of polyethylene, polypropylene and oxidized polyethylene particles) (Shamrock Technologies, Inc.) (0.02 g/m$^2$) in a cellulose acetate propionate binder (2.5% acetyl, 45% propionyl) (0.30–0.40 g/m$^2$) from a toluene, methanol, and cyclopentanone solvent mixture.

On the reverse side of the support was coated:

(1) Subbiny layer of Tyzor TBT (0.12 g/m$^2$) from a n-propyl acetate and 1-butanol solvent mixture.

(2) Adhesion layer of cellulose acetate propionate (2.5% acetyl, 45% propionyl) (0.11 g/m$^2$) coated from a toluene, methanol and cyclopentanone solvent mixture.

(3) Slipping layer of cellulose acetate propionate (2.5% acetyl, 45% propionyl) (0.532 g/m$^2$), PS-513 (an aminopropyl dimethyl terminated polydimethyl siloxane) (Petrarch Systems, Inc.) (0.011 g/m$^2$), p-toluene sulfonic acid (5% in methanol) (0.0003 g/m$^2$), and candelilla wax particles (0.021 g/m$^2$) coated from a toluene, methanol and cyclopentanone solvent mixture.

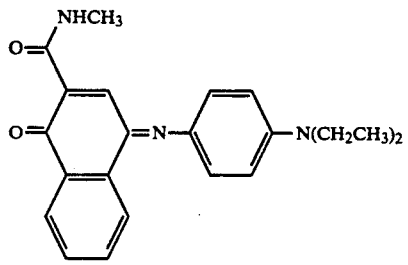

(Cyan Dye 1)

-continued

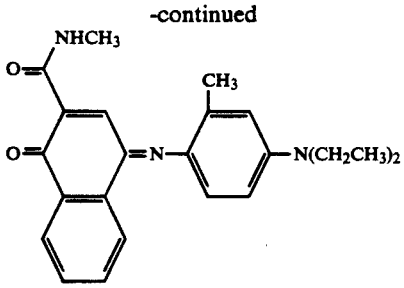

(Cyan Dye 2)

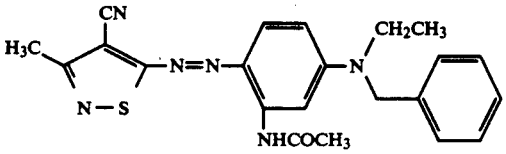

(Magenta Dye 1)

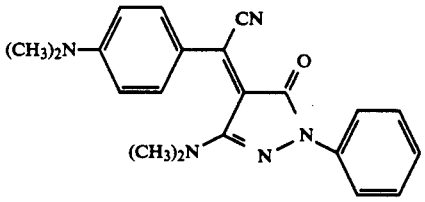

(Magenta Dye 2)

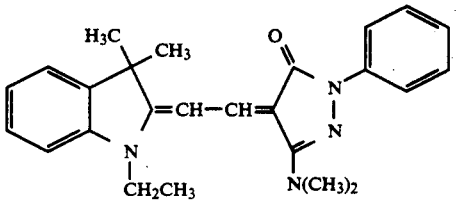

(Yellow Dye 1)

The dye side of the dye-donor element approximately 10 cm×13 cm in area was placed in contact with the polymeric receiving layer side of the dye-receiver element of the same area. The assemblage was fastened to the top of a motor-driven 56 mm diameter rubber roller and a TDK Thermal Head L-231, thermostated at 32° C., was pressed with a spring at a force of 36 Newtons (3.6 kg) against the dye-donor element side of the assemblage pushing it against the rubber roller.

The imaging electronics were activated and the assemblage was drawn between the printing head and roller at 10.8 mm/sec. Coincidentally, the resistive elements in the thermal print head were pulsed in a determined pattern for 64 μsec/pulse at 129 μsec intervals during the 17.1 msec/dot printing time to create an image. When desired, a stepped density image was generated by incrementally increasing the number of pulses/dot from 0 to 127. The voltage supplied to the print head was approximately 15.5 volts, resulting in an instantaneous peak power of 0.467 watts/dot and a maximum total energy of 3.8 mjoules/dot.

Individual cyan, magenta and yellow images were obtained by printing from three dye-donor patches. When properly registered a full color image was formed. The Status A red, green, and blue reflection density of the stepped density image at maximum density were read and recorded. In all cases a maximum density of 2.0 or more was obtained showing the receiver polymers effectively accepted dye.

The images were then subjected to a high intensity daylight fading test of exposure for 1 week, 50 kLux, 5400° K., approximately 25% RH. The Status A red, green and blue reflection densities for the step of each dye image having an initial density nearest to 1.0 were compared before and after fade and the percent density loss was calculated. The results are presented in Table I below.

TABLE I

| Receiver Polymer | Tg (°C.) | Status A Blue Initial O.D. | Status A Blue % Fade | Status A Green Initial O.D. | Status A Green % Fade | Status A Red Initial O.D. | Status A Red % Fade |
|---|---|---|---|---|---|---|---|
| P-1 | 59 | 1.04 | 13 | 1.07 | 23 | 1.17 | 11 |
| P-2 | 61 | 1.04 | 19 | 1.09 | 23 | 1.13 | 11 |
| C-1 | 104 | * | * | * | * | * | * |
| C-2 | 69 | 0.87 | 66 | 1.06 | 51 | 1.11 | 14 |
| C-3 | 80 | 0.95 | 43 | 1.01 | 51 | 1.14 | 12 |

* No data available - Undispersible polymer

As can be seen from the above data, the polyester ionomers of the invention exhibited substantially less dye fade relative to the comparison polymers.

EXAMPLE 2

Dye-receiving elements were prepared by extrusion laminating a 38 μm thick microvoided composite film (OPPalyte 350 TW, Mobil Chemical Co., consisting of a microvoided and oriented polypropylene core (approximately 73% of the total film thickness, poly(butylene terephthalate) void initiating material) with a titanium dioxide pigmented non-microvoided orientated polypropylene layer on each side) to a 140 μm thick support paper stock (as described in Example 1) with 12 g/m² pigmented polyolefin (polyethylene containing rutile titanium dioxide (17.5 % by weight) and a stilbene-benzoxazole optical brightener (0.05 % by weight)). The backside of the stock support was extrusion coated with high density polyethylene (37 g/m²). The composite film side of the resulting laminate was then coated with:

(1) Subbing layer of poly(acrylonitrile-co-vinylidene chloride-co-acrylic acid) (15:79:6 wt. ratio) (0.11 g/m²) and Triton TX-100 (Eastman Kodak Co.) (0.016 g/m²) from distilled water.

(2) Dye-receiving layer composed of polyester ionomer P-3, P-4, or P-5 (3.23 g/m²) with 10G (polyglycidol of Olin Co.)(0.021 g/m²) from distilled water.

(3) Overcoat layer of a linear condensation copolycarbonate of bisphenol-A (50 mole %), diethylene glycol (49 mole %), and 2,500 MW polydimethylsiloxane block units (1 mole %) (0.11 g/m²), Fluorad FC-431 (surfactant of 3M Corp.) (0.02 g/m²) and Dow Corning 510 Silicone Fluid (0.01 g/m²) from dichloromethane solvent.

The polyester ionomers were dispersed in water at levels ranging from 10 wt% to 20 wt% prior to coating. All coatings were dried at ambient room conditions for at least 16 hours prior to evaluation.

Individual cyan, magenta, yellow and neutral images were obtained using the dye donor materials and similar printing conditions described in Example 1. The Status A red, green, and blue reflection density of the stepped density image at maximum density were read and recorded. In all cases a maximum density of 1.8 or more was obtained showing the receiver polymers effectively accepted dye.

The images were then subjected to a high intensity daylight fading test of exposure for 1 week, 50 kLux, 5400° K., approximately 25% RH. The Status A red, green and blue reflection densities for the step of each dye image having an initial density nearest to 1.0 were compared before and after fade and the percent density loss was calculated. The results are presented in Table II below.

TABLE II

| | | % FADE | | % FADE | | % FADE | |
|---|---|---|---|---|---|---|---|
| Receiver Polymer | Tg (°C.) | Yellow | Yellow/Neutral | Magenta | Magenta/Neutral | Cyan | Cyan/Neutral |
| P-3 | 65 | 20 | 9 | 20 | 7 | 30 | 22 |
| P-4 | 70 | 16 | 7 | 20 | 5 | 24 | 18 |
| P-5 | 90 | 9 | −1 | 15 | 1 | 14 | 12 |

The above data show that polyester ionomer P-5 of the invention having ionic monomer units derived from diester monomers which contain an iminodisulfonyl group within the atom chain between the two carboxy groups is particularly beneficial for minimizing dye fade.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer containing a thermally-transferred dye image, wherein the dye image-receiving layer comprises a water dispersible polyester comprising recurring dibasic acid derived units and diol derived units, at least 50 mole % of the dibasic acid derived units comprising dicarboxylic acid derived units containing an alicyclic ring within two carbon atoms of each carboxyl group of said dicarboxylic acid, and at least 2.5 mole % of the dibasic acid derived units and diol derived units combined comprising ionic monomer derived units containing an ionic group, said ionic monomer derived units being derived from diester monomers which contain metal ion salts of sulfonic acids or iminodisulfonyl groups.

2. The element of claim 1, wherein at least 20 mole % of the diol derived units of the polyester contain an aromatic ring not immediately adjacent to each hydroxyl group of the corresponding diol or an alicyclic ring.

3. The element of claim 1, wherein the alicyclic rings of the dicarboxylic acid derived units comprise from 4 to 10 ring carbon atoms.

4. The element of claim 3, wherein the alicyclic rings of the dicarboxylic acid derived units comprise 6 ring carbon atoms.

5. The element of claim 1, wherein the polyester has a number average molecular weight of from 10,000 to 250,000.

6. The element of claim 5, wherein the polyester has a number average molecular weight of from 20,000 to 100,000.

7. The element of claim 1, wherein the polyester has a glass transition temperature greater than about 40° C.

8. The element of claim 7, wherein the polyester has a glass transition temperature between 40° C. and 120° C.

9. The element of claim 1, wherein the dicarboxylic acid derived units are derived from 1,4-cyclohexanedicarboxylic acid and the diol derived units are derived from 0 to 80 mole percent ethylene glycol and 20 to 100 mole percent 1,4-cyclohexanedimethanol.

10. The element of claim 1, wherein at least 5 mole % of the dibasic acid derived units of the polyester comprise dicarboxylic acid derived units containing an ionic group.

11. The element of claim 1, wherein the diester monomer units contain an iminodisulfonyl group within the atom chain between the two carboxy groups of the diester.

12. The element of claim 1, wherein the dicarboxylic acid derived units containing an ionic group are derived from diester monomers which contain metal ion salts of sulfonic acids.

13. The element of claim 1, wherein at least 20 mole % of the diol derived units of the polyester contain an alicyclic ring.

14. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, wherein the dye image-receiving layer comprises a water dispersible polyester comprising recurring dibasic acid derived units and diol derived units, at least 50 mole % of the dibasic acid derived units comprising dicarboxylic acid derived units containing an alicyclic ring within two carbon atoms of each carboxyl group of said dicarboxylic acid, and at least 2.5 mole % of the dibasic acid derived units and diol derived units combined comprising ionic monomer derived units containing an ionic group, said ionic monomer derived units being derived from diester monomers which contain metal ion salts of sulfonic acids or iminodisulfonyl groups.

15. The process of claim 14, wherein at least 5 mole % of the dibasic acid derived units of the polyester comprise dicarboxylic acid derived units containing an ionic group.

16. A thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein the dye image-receiving layer comprises a water dispersible polyester comprising recurring dibasic acid derived units and diol derived units, at least 50 mole % of the dibasic acid derived units comprising dicarboxylic acid derived units containing an alicyclic ring within two carbon atoms of each carboxyl group of said dicarboxylic acid, and at least 2.5 mole % of the dibasic acid derived units and diol derived units combined comprising ionic monomer derived units containing an ionic group, said ionic monomer derived units being derived from diester monomers which contain metal ion salts of sulfonic acids or iminodisulfonyl groups.

17. The assemblage of claim 16, wherein at least 5 mole % of the dibasic acid derived units of the polyester comprise dicarboxylic acid derived units containing an ionic group.

* * * * *